United States Patent [19]

Riddiford

[11] Patent Number: 4,776,381

[45] Date of Patent: Oct. 11, 1988

[54] BLINDS

[76] Inventor: Bruce Riddiford, 60 Balsatic Road, Unit 16, Concord, Ontario, Canada, L4K 1G7

[21] Appl. No.: 878,672

[22] Filed: Jun. 26, 1986

[51] Int. Cl.[4] ..... E06B 9/32

[52] U.S. Cl. ..... 160/172; 160/84.1; 160/178.1; 188/82.1

[58] Field of Search ..... 160/168 R, 178 C, 84 R, 160/172, 166 R; 242/147, 156, 156.1; 188/82.1, 82.3, 82.34

[56] References Cited

U.S. PATENT DOCUMENTS

| | | | |
|---|---|---|---|
| 2,129,606 | 9/1938 | Nisenson | 160/168 |
| 2,202,358 | 5/1940 | Stone | 160/84 R X |
| 3,721,285 | 3/1973 | Debs | 160/166 R |
| 3,799,236 | 3/1974 | Debs | 160/178 C |
| 3,818,969 | 6/1974 | Debs | 160/172 X |
| 3,952,789 | 4/1976 | Marotto | 160/178 C |
| 4,057,220 | 11/1977 | Kudlacek | 188/82.1 X |
| 4,202,395 | 5/1980 | Heck et al. | 160/279 X |
| 4,433,713 | 2/1984 | Kelly | 160/166 R |
| 4,473,101 | 9/1984 | Langeler | 160/279 X |
| 4,557,309 | 12/1985 | Judkins | 160/279 X |

*Primary Examiner*—Ramon S. Britts
*Assistant Examiner*—David M. Purol
*Attorney, Agent, or Firm*—Fetherstonhaugh & Co.

[57] ABSTRACT

A universal tensioning device for blinds and shades comprises a U-shaped channel member which has oppositely disposed open ends which provide first and second access passages and a third access passage opening through the bottom wall of the channel member. A winding shaft is mounted for rotation in the side walls of the channel member and extends transversely across the channel directly above the third access passage. A ratchet wheel is provided at one end of the winding shaft and is located externally of a side wall of the channel. A socket is formed in the end of the winding shaft. A dog is pivotally mounted on the side wall of the channel member for movement into and out of engagement with the ratchet wheel. A biasing spring is provided for releaseably urging the dog toward the ratchet wheel. A pair of these tensioning devices are located in a chamber formed in the header rail of a venetian blind which also accommodates the slat angling mechanism and height adjustment mechanism. An inclined shade is also provided in which a pair of shade support wires are provided for supporting the shade in an inclined plane.

3 Claims, 3 Drawing Sheets

BLINDS

Figure 1:
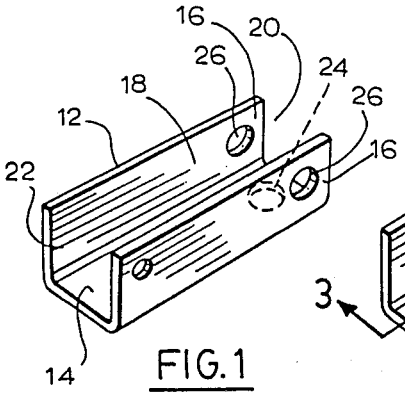

This invention relates to blinds and shades. In particular, this invention relates to a tensioning device suitable for use in a header channel of a blind or shade.

When a venetian blind or a pleated shade is mounted on the underside of an inclined window, tensioning wires are run through the blind or shade to support the body of the blind or shade in a plane extending parallel to the window. Considerable difficultly has been experienced in attempting to provide simple and efficient tensioning devices for use in tensioning the support wires. It is an object of the present invention to provide a simple and inexpensive tensioning device suitable for use in tensioning the support wires of an angled blind or shade.

Difficulty has also been experienced in providing a tensioning device which is universal and which can be used on either side of the passage which is formed in the header through which the support wire extends. Because of the limited availability of space in the header channel, it is usually necessary to mount one tensioning device so that it faces in one direction and the other tensioning device so that is faces in the opposite direction. For this reason, tensioning devices of opposite ends may be required. In addition, in pleated shade applications the tensioning device is preferably mounted directly above the passage through which the support wire extends.

It is an object of the present invention to provide a tensioning device which is universal and which can be mounted on either side of the support wire outlet passage of the header.

Difficulty has also been experienced in attempting to releaseably retain an inclined shade in an extended position. In many applications, the position in which the movable header of the shade is located when the shade is fully extended, is not readily accessible and for this reason latching mechanisms are difficult to manipulate.

It is an object of the present invention to provide a simple and inexpensive form of fastening mechanism for releaseably fastening the pleated blind in the extended position. The present invention also provides a simple and inexpensive hand tool suitable for use in manually moving the movable header of a pleated blind to an extended position and for releasing the movable header from the fixed header.

SUMMARY OF INVENTION

According to one aspect of the present invention, there is provided a tensioning device for use in a header channel of a blind or shade on either side or directly above a tension wire port of the header comprising a mounting bracket having a bottom wall and first and second side walls arranged to form a U-shaped channel which has oppositely disposed open first and second ends which respectively provide first and second access passages opening into said channel and a third access panel opening from said channel through said bottom wall, a pair of mounting passages opening through said side walls, said mounting passages being arranged directly above said third access passage, a winding shaft having a winding axis, said winding shaft being mounted in said mounting passages of said bracket for rotation about said winding axis, a ratchet wheel on one end of said winding shaft, said ratchet wheel being rotated outwardly from said first side wall, a socket at one end of said shaft which is engageable with a torque applying tool to rotatably drive said shaft, a dog pivotally mounted on said first wall of said bracket adjacent said ratchet and spring biased into releasable engagement with said ratchet wheel so as to permit rotation of said winding shaft in one direction and being movable out of engagement with said ratchet wheel to permit rotation in the other direction.

According to a further aspect of the present invention, there is provided in a venetian blind having a header rail, a base rail, a plurality of blind slats, a chamber formed in the header rail, two slat angling mechanisms located in said chamber, slat angle adjustment cables depending from each of said mechanisms through underlying first passage formed in the bottom wall of the header rail, a height adjustment mechanism mounted in said chamber, two height adjustment cables extending into said chamber and having a portion of their length depending from said header rail through height adjustment passages formed in the bottom wall of the header rail approximate said first passages, said height adjustment cables extending through height adjustment passages in each slat and being connected to the bottom rail, said header rail having an inner wall which faces away from the window opening in which the blind is mounted in use, the improvement of a pair of identical blind tensioning devices each comprising a mounting bracket having a bottom wall and first and second side walls arranged to form a U-shaped channel which has oppositely disposed open first and second ends which respectively provide first and second access passages opening into said channel and a third access panel opening from said channel through said bottom wall, a pair of mounting passages opening through said side wall, said mounting passages being arranged directly above said third access passage, a winding shaft having a winding axis, said winding shaft being mounted in said mounting passages of said bracket for rotation about said winding axis, a ratchet wheel on one end of said winding shaft, said ratchet wheel being rotated outwardly from said first side wall, a socket at one end of said shaft which is engageable with a torque applying tool rotatably drive said shaft, a dog pivotally mounted on said first wall of said bracket adjacent said ratchet and spring biased into releaseable engagement with said ratchet wheel so as to permit rotation of said winding shaft in one direction and being movable out of engagement with said ratchet wheel to permit rotation in the ohter direction, said tensioning devices being mounted in said chamber on said bottom wall between said height adjustment passages with the first access passage of one tensioning device opening toward its adjacent height adjustment passage and the second access passage of the other tensioning device opening toward its adjacent height adjustment passage such that the sockets of the winding shafts and the dogs associated therewith each face said inner wall of said header rail, said inner wall of said header rail having tension adjustment passages opening therethrough in alignment with each tensioning shaft to provide access to the socket dog of each assembly to permit tightening and release of each winding shaft, a blind support wire for each winding shaft, each blind support wire having one end mounted on its associated winding shaft and extending therefrom through the appropriate access passage of said mounting bracket to the adjacent height adjustment passage of the header rail and through the underlying height adjustment passages of the slats, the other end of each blind support wire being anchored to the bottom rail.

Figure 2:
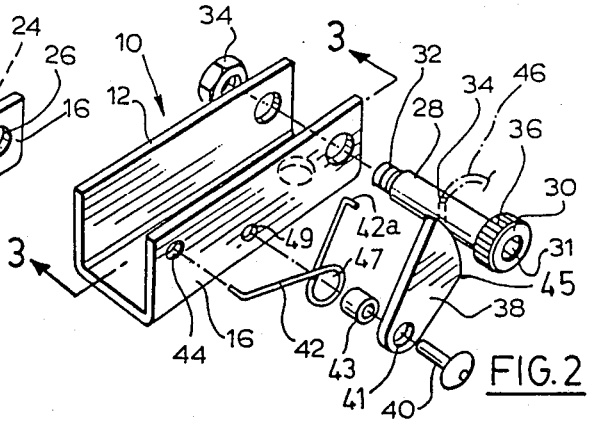
Figure 3:
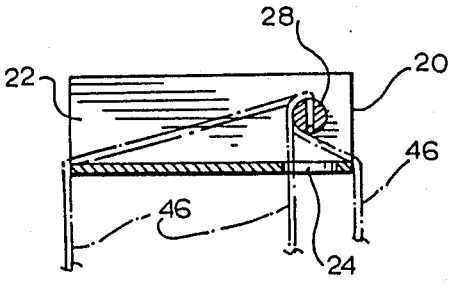
Figure 4:
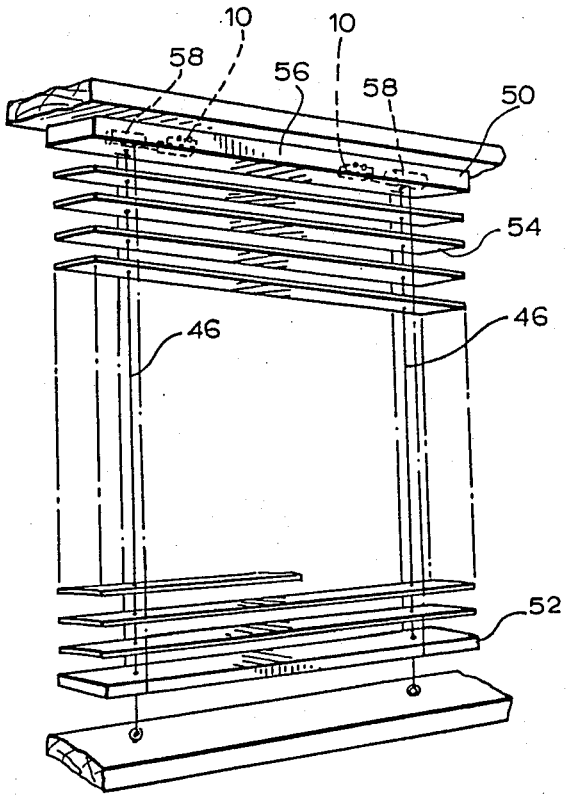
Figure 5:
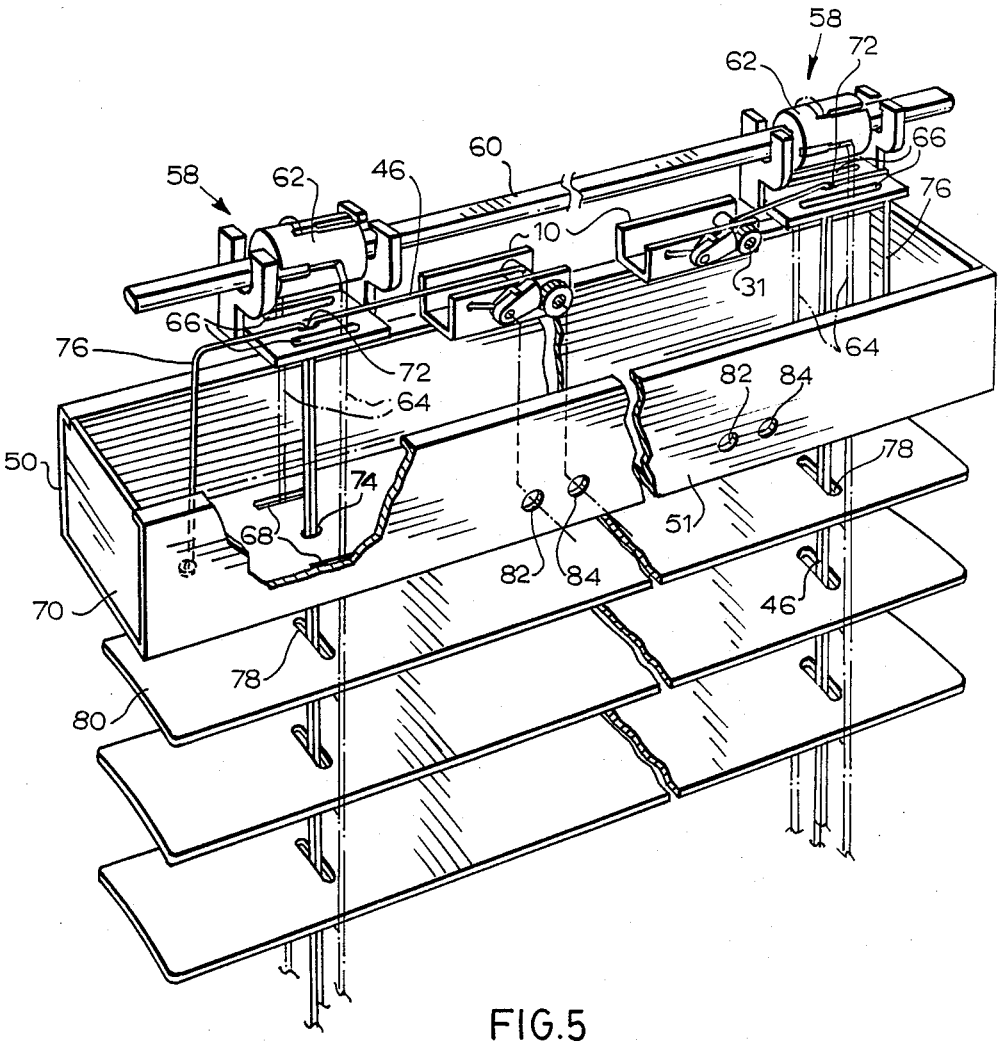
Figure 6:
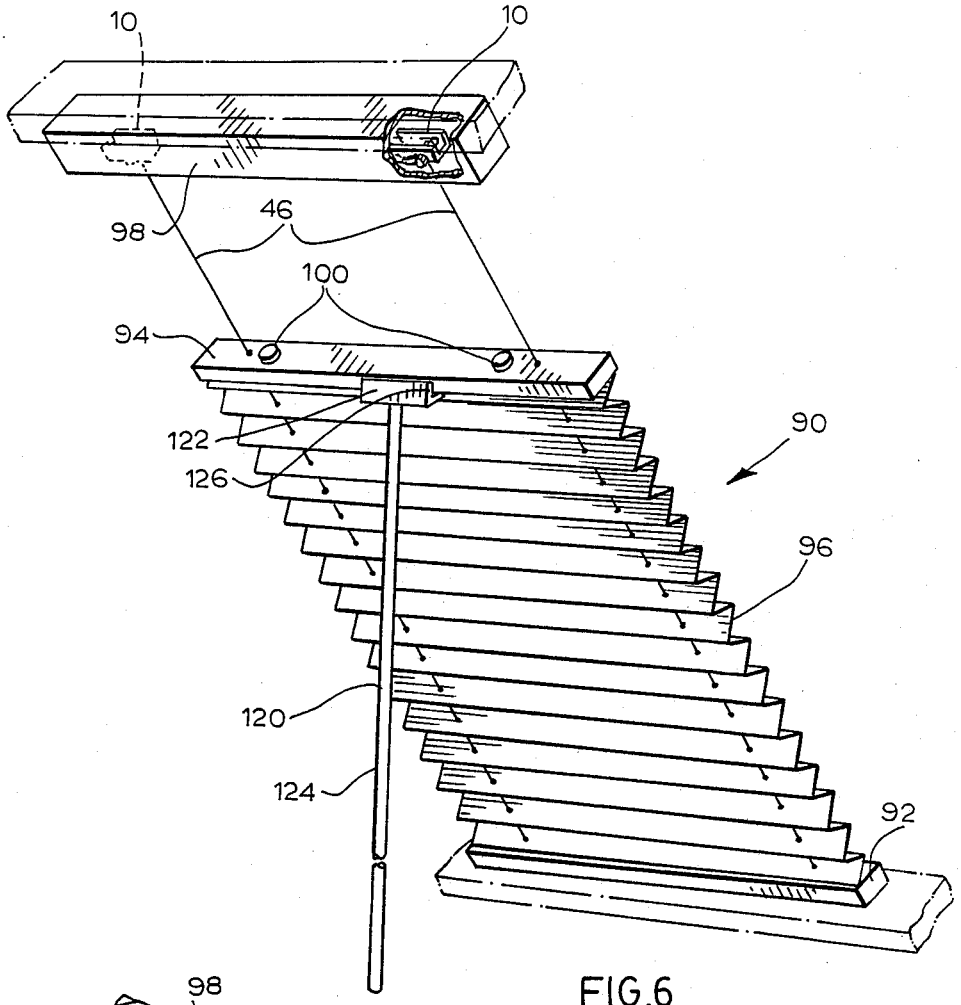
Figure 7:
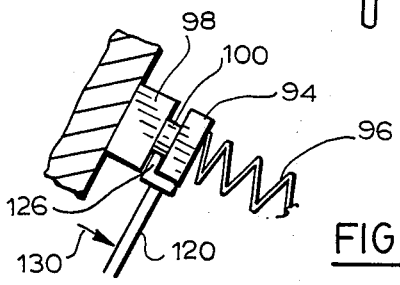

According to a still further aspect of the invention, an inclined shade comprises a sill member mounted in the window opening, a fixed header member mounted in said window opening above said sill member, a movable header member disposed between the sill member and the fixed header member, a pleated shade having a lower end connected to the sill member and an upper end connected to the movable header, a pair of shade support wires, one end of each support wire being connected to the sill member and the other end being connected to the fixed header, tension adjustment means mounted in each fixed header for adjusting the tension of each support wire to maintain the support wires in the taught condition extending between the fixed header member and the sill member, fastener means carried by one of said header members for releaseably securing it to the other of said header members to retain the pleated shade in an extended position, said support cables extending through openings in each pleat of the pleated shade to support the pleated The invention will be more clearly understood after reference to the following detailed specification read in conjunction with the drawings wherein;

FIG. 1 is a pictorial view of the mounting bracket portion of the tensioning device of the present invention, FIG. 2 is a pictorial view of a tensioning device constructed in accordance with an embodiment of the present invention, FIG. 3 is a sectional side view taken along the line 3—3 of FIG. 2, FIG. 4 is a pictorial view of a venetian blind of the type in association with which the tensioning device of the present invention may be used, FIG. 5 is an exploded view of the header rail and tensioning devices showing the location of the tensioning devices, FIG. 6 is a pictorial view of an angularly inclined pleated shade, FIG. 7 is a side view of the fixed header and movable header showing the positioning of the manipulating tool prior to the release of the movable header.

With reference to FIG. 2 of the drawings, the reference numeral 10 refers generally to a tensioning device constructed in accordance with an embodiment of the present invention. The tensioning device 10 comprises a U-shaped mounting bracket 12 which, as shown in FIG. 1 of the drawings, has a bottom wall 14 and a pair of oppositely disposed side walls 16 which cooperate to form a U-shaped channel 18. The U-shaped channel 18 has a first open end 20 and a second open end 22 which provide first and second access passages which open into the channel. A third access passage 24 is in the form of an opening which extends through the bottom wall 14. A pair of oppositely disposed mounting passages 26 are formed in the side walls 16 and are arranged to be aligned with one another substantially directly above the third access passage 24.

With reference to FIG. 2 of the drawings, it will be seen that the tensioning device also includes a winding shaft 28 which has a ratchet wheel 30 at one end thereof and a threaded stem 32 at the other end thereof. The shaft 28 is proportioned to extend through the passages 26. The ratchet wheel 30 will bear against the outer face of the side wall 16 and the nut 33 is threaded onto the threaded stem 32 in order to bear against the outer surface of the other side wall 16 to secure the winding shaft 28 in a position extending across the channel 18. A wire mounting passage 34 extends diametrically through the winding shaft 28. A plurality of ratchet teeth 36 are formed on the outer perimeter of the ratchet wheel 30. The tensioning device also comprises a dog 38, a biasing spring 42, a support sleeve 43 and a rivet 40. The dog 38 has a mounting passage 41 formed at its proximal end and a biting edge 45 formed at its distal end for engagement with the ratchet teeth 36. The mounting sleeve 43 extends through the mounting passage 41 of the dog 38 and through the mounting eye 47 of the biasing spring 42 and has its opposite ends bearing against the side wall 16 of the channel shaped member and the head of the rivet 40 so as to permit the rivet 40 to be riveted in position without clamping the ratchet arms 38 and tensioning spring between its head and the side wall 16. One end of the spring 42 extends into the passage 44 formed in the side wall 16 while the other end bears against the upper edge of the dog 38. The distal end of the dog 38 is arranged to bear against the ratchet teeth of the ratchet wheel to lock the ratchet wheel against rotation in the counterclockwise direction in the structure illustrated in FIG. 2 of the drawings.

As shown in FIG. 3 of the drawings, a support wire 46 may have one end positioned in the wire mounting passage 34 and may extend from the winding shaft 28 through either the first access passage 20, the second access passage 22, or the third access passage 24. A venetian blind in which the tensioning devices of the present invention may be employed is illustrated in FIG. 4 of the drawings, wherein it will be seen that the blind consists of a header rail 50, a base rail 52 and a plurality of blind slats 54. A chamber 56 is formed in the header rail 50 and two slat angling mechanisms 58 are positioned in the chamber 56. The slat angling mechanisms 58 (FIG. 5) are connected by a drive shaft 60. This slat angling mechanism is a well known structure and will not therefore be described in detail. The slat angling mechanisms 58 each have a winding drum 62 from which angling cables 64 depend through passages 66 and 68 which are formed in the frame of the angling mechanism and in the bottom wall 70 of the header rail 50. A height adjusting passage 72 is formed in the frame of the angling mechanism and is aligned with a height adjusting passage 74 which is formed in the bottom wall 70 of the header. A height adjusting cable 76 extends through the passages 72 and 74 and through the slots formed in the slats to be connected to the bottom rail 52 in a conventional manner. The support wire 46 from the adjacent tensioning device 10 extends downwardly through the passages 72 and 74 and through the slots 78 formed in the slats 80 of the blind and are connected at the lower end to the bottom rail 52. A tension adjustment passage 82 and a dog release passage 84 are formed in the inner side wall 51 of the header rail 50 and are arranged to be aligned with the socket 31 which is formed in the end of the ratchet wheel 30 and a dog 38 respectively. The socket 31 is preferably formed to receive an allen key. The allen key may be inserted through the passage 82 into the socket 31 for the purposes of rotating the winding shaft 28 to tension the support wires 46. A sharp instrument such as an nail may be inserted through the passage 84 and used to lever the dog 38 upwardly out of engagement with the ratchet teeth 36 of the ratchet wheel thereby releasing the ratchet wheel for rotation to release the tension in the support cables.

With reference to FIG. 6 of the drawings, the reference numeral 90 refers generally to a pleated shade assembly which includes a sill member 92, a movable header 94 and a pleated body 96. A fixed header 98 is also provided. In use, the fixed header 98 is mounted on the header of a window frame and the sill member 92 is mounted on the sill of a window frame. The fixed header member 98 has two tensioning devices 10 located therein. Support wires 46 extend from each tensioning device 10 through passages formed in the movable header 94 and passages formed in each pleat of the pleated shade 96 and are anchored in the bottom rail 92. A pair of magnets 100 are mounted on the movable header 94 and are arranged to be positioned in a face-to-face relationship with respect to the fixed rail 98 to fasten the fixed rail 98 to the movable rail 94.

A manipulating tool suitable for opening and closing the shade is generally identified by the reference numeral 120 and includes an L-shaped head portion 122 and a shaft portion 124. For the purposes of moving the movable header member 94 to the closed position, the L-shaped head is arranged to support the movable header 94 and by raising the head 122 of the tool 120 towards the fixed header 98, the movable header 94 is moved toward the fixed header. In order to release the fixed header, the tool 122 is arranged as shown in FIG. 7 so that the flange portion 126 is inserted between the fixed header 98 and the movable header 94 and is moved in the direction of the arrow 130 to move the movable header away from the fixed header.

From the foregoing it will be apparent that the present invention provides a simple and inexpensive tensioning device for use in the header channel of a blind or shade.

I claim:

1. A tensioning device for use in a header channel of a blind or shade on either side or directly above a tension wire port of the header comprising:

(a) a mounting bracket having a bottom wall and first and second side walls arranged to form a U-shaped channel which has oppositely disposed open first and second ends a pair of mounting passages opening through said side walls, (b) a winding shaft having a winding axis, said winding shaft extending across said channel and being mounted in said mounting passages of said bracket for rotation about said winding axis, unobstructed first and second access passages extending along said channel from said first and second open ends respectively to provide unobstructed access to the winding shaft for a tensioning wire extending through any area of the first or second open ends, a third access passage opening from said channel through said bottom wall, said third access passage being located directly below the winding shaft whereby a tension wire may pass therethrough without contacting the mounting bracket, (c) a ratchet wheel on one end of said winding shaft, said ratchet wheel being mounted for rotation outwardly from said first side wall, (d) a socket at one end of said shaft which is engageable with a torque applying tool to rotatably drive said shaft, (e) a dog pivotally mounted on the outer side of said first wall of said bracket adjacent said ratchet by means of a pivot pin which is mounted in said first side wall and has its inner end spaced a substantial distance from the second side wall so that it does not form an obstruction in said unobstructed access passages, said dog being spring biased into releasable engagement with said ratchet wheel so as to permit rotation of said winding shaft in one direction and being movable out of engagement with said ratchet wheel to permit rotation in the other direction.

2. In a venetian blind having a header rail, a base rail, a plurality of blind slats, a chamber formed in the header rail, two slat angling mechanisms located in said chamber, slat angle adjustment cables depending from each of said mechanisms through underlying first passage formed in the bottom wall of the header rail, a height adjustment mechanism mounted in said chamber, two height adjustment cables extending into said chamber and having a portion of their length depending from said header rail through height adjustment passages formed in the bottom wall of the header rail approximate said first passages, said height adjustment cables extending through height adjustment passages in each slat and being connected to the bottom rail, said header rail having an inner wall which faces away from the window opening in which the blind is mounted in use, the improvement of:

(a) a pair of identical blind tensioning devices each comprising;

(i) a mounting bracket having a bottom wall and first and second slide wall arranged to form a U-shaped channel which has oppositely disposed open first and second ends a pair of mounting passages opening through said side walls, (ii) a winding shaft having a winding axis, said winding shaft extending across said channel and being mounted in said mounting passages of said bracket for rotation about said winding axis, unobstructed first and second access passages extending along said channel from said first and second open ends respectively to provide unobstructed access to the winding shaft for a tensioning wire extending through any area of the first or second open ends, a third access passage opening from said channel through said bottom wall, said third access passage being located directly below the winding shaft whereby a tension wire may pass therethrough without contacting the mounting bracket, (iii) a ratchet wheel on one end of said winding shaft, said ratchet wheel being mounted for rotation outwardly from said first side wall, (iv) a socket at one end of said shaft which is engageable with a torque applying tool to rotatably drive said shaft, (v) a dog pivotally mounted on the outer side of said first wall of said bracket adjacent said ratchet wheel by means of a pivot pin which is mounted in said first side wall and has its inner end spaced a substantial distance from the second side wall so that it does not form an obstruction in said unobstructed access passages, said dog being spring biased into releaseable engagement with said ratchet wheel so as to permit rotation of said winding shaft in one direction and being movable out of engagement with said ratchet wheel to permit rotation in the other direction, (vi) said tensioning devices being mounted in said chamber on said bottom wall between said height adjustment passages with the first access passage of one tensioning device opening toward its adjacent height adjustment passage and the second access passage of the other tensioning device opening toward its adjacent height adjustment passage such that the sockets of the winding shafts and the dogs associated therewith each face said inner wall of said header rail, said inner wall of said header rail having tension adjustment passages opening therethrough in alignment with each tensioning shaft to provide access to the socket of each assembly to permit tightening and release of each winding shaft, a blind support wire for each winding shaft, each blind support wire having one end mounted on its associated winding shaft and extending therefrom through the appropriate access passage of said mounting bracket to the adjacent height adjustment passage of the header rail and through the underlying height adjustment passages of the slats, the other end of each blind support wire being anchored to the bottom rail.

3. An inclined shade comprising a sill member mounted in the window opening, a fixed header member mounted in said window opening above said sill member, a movable header member disposed between the sill member and the fixed header member, a pleated shade having a lower end connected to the sill member and an upper end connected to the movable header, a pair of shade support wires, one end of each support wire being connected to the sill member and the other end being connected to the fixed header, tension adjustment means mounted in each fixed header for adjusting the tension of each support wire to maintain the support wires in the taught condition extending between the fixed header member and the sill member, said tension adjustment menas including a mounting bracket having a bottom wall and first and second side walls arranged to form a U-shaped channel which has oppositely disposed open first and second ends, a winding shaft having a winding axis, said winding shaft extending across said channel and being mounted in said mounting passages of said bracket for rotation about said winding axis, unobstructed first and second access passages extending along said channel from said first and second open ends respectively to provide unobstructed access to the winding shaft for a tensioning wire extending through any area of the first or second open ends, a third access passage opening from said channel through said bottom wall, said third access passsage being located direclty below the winding shaft whereby a tension wire may pass therethrough without contacting the mounting bracket, a ratchet wheel on one end of said winding shaft, said ratchet wheel being mounted for rotation outwardly from said first side wall, a socket at one end of said shaft which is engageable with a torque applying tool to rotatably drive said shaft, and a dog pivotally mounted on the outer side of said first wall of said bracket adjacent said ratchet by means of a pivot pin which is mounted in said first side wall and has its inner end spaced a substantial distance from the second side wall so that it does not form an obstruction in said unobstructed access passages, said dog being spring biased into releaseable engagement with said ratchet wheel so as to permit rotation of said winding shaft in one direction and being movable out of engagement with said ratchet wheel to permit rotation in the other direction, magnetic fastener means carried by one of said header members for releaseably securing it to the other of said header members to retain the pleated shade in an extended position, said magnetic fastener projecting from the header member on which it is carried and serving to space said header members from one another when the shade is in the extended position thereby to provide a release access gap between the headers into which a release hook may be inserted to pry the magentically secured headers apart to release the movable header, said support cables extending through openings in each pleat of the pleated shade to support the pleated shade.

* * * * *